United States Patent [19]

Pagano

[11] Patent Number: 4,948,082

[45] Date of Patent: Aug. 14, 1990

[54] FOLDABLE BOOK HOLDER

[76] Inventor: Sam Pagano, 1632 Squaw Creek Dr., Girard, Ohio 44420

[21] Appl. No.: 375,041

[22] Filed: Jul. 3, 1989

[51] Int. Cl.[5] ..... A47B 97/00

[52] U.S. Cl. ..... 248/460; 248/453; 248/447.2

[58] Field of Search ..... 248/460, 453, 462, 458, 248/457, 454, 447.2, 461, 452

[56] References Cited

U.S. PATENT DOCUMENTS

| | | |
|---|---|---|
| 490,569 | 1/1893 | Lehman . |
| 1,126,410 | 1/1915 | Daly . |
| 2,595,682 | 5/1952 | Lipa . |
| 3,562,796 | 2/1971 | Jacobson . |

*Primary Examiner*—Karen J. Chotkowski

*Attorney, Agent, or Firm*—Harpman & Harpman

[57] ABSTRACT

A foldable book holder having oppositely disposed pairs of pivoted arms extending from a base. The book holder is engageable adjacent the edge of a table or desk and provides both display and storage of large illustrated books.

7 Claims, 2 Drawing Sheets

FOLDABLE BOOK HOLDER

BACKGROUND OF THE INVENTION

1. Technical Field

This device relates to support stands and holder for books that allow to be displayed in an open configuration. These types of holders are self-supporting and hold the pages of the book opened and can be adjusted in angled display position.

2. Description of Prior Art

Prior Art devices of this type have relied on a variety of different design configurations to hold and display books positioned thereon, see for example U.S. Pat. Nos. 490,569, 1,126,410, 2,595,682 and 3,562,796.

In U.S. Pat. No. 490,569 a book rest is disclosed that is comprised of a rectangular support base and an upstanding inclined wire book engagement elements.

U.S. Pat. No. 1,126,410 shows a foldable support for drawing boards having a hinged and main support element from which extends a T-shaped board engaging element. Front support is via a wire L-shaped bracket extending under a table edge and J-hooks engaging the lower part of an engageable board.

In U.S. Pat. No. 2,595,682 a holder for books is disclosed having a base from which extends a book rest panel with an angularly disposed shelf hinged to the book rest. Finger or leaf holds are pivoted to either side of said shelf and are used to selectively engage the pages of a book positioned on the shelf. U.S. Pat. No. 3,562,796 is drawn to a reading stand of all wire construction that is foldable. The stand has a wire base support element with an angularly inclined book engaging wire frame therefrom which is adjustable to the degree of inclination required.

SUMMARY OF THE INVENTION

A self-contained foldable book holder for use on a table or desk edge that provides a hands free display of a large children's type illustrative book. The book holder has tapered engageable book support arms with storage arms to store additional books not open and in use.

Description of the Preferred Embodiment

Figure 1:
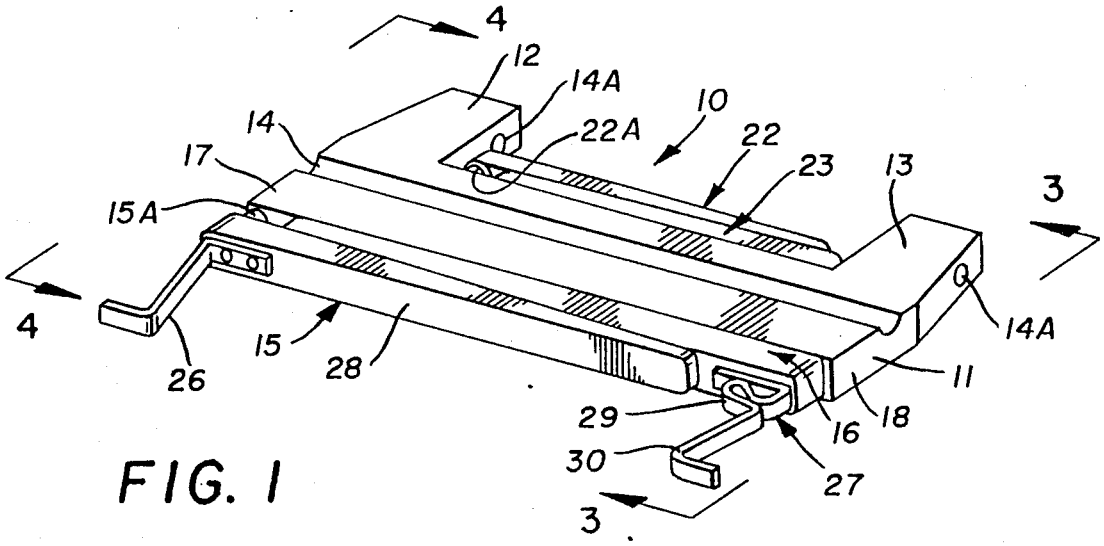
FIG. 1 is a perspective view of the book holder in folded closed position.
Figure 2:
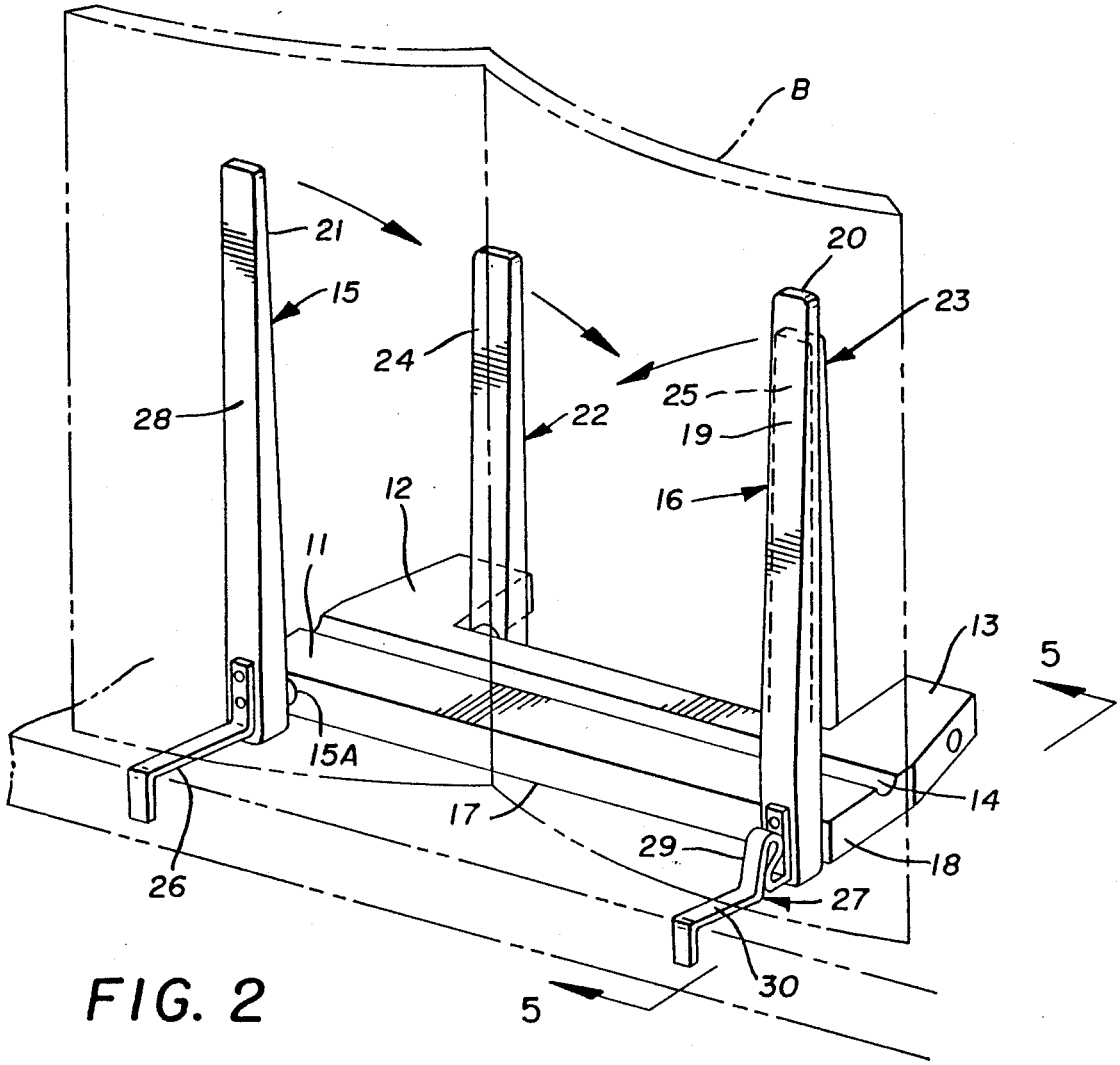
FIG. 2 is a perspective view of the book holder in open extended position with a book representation thereon.
Figure 3:
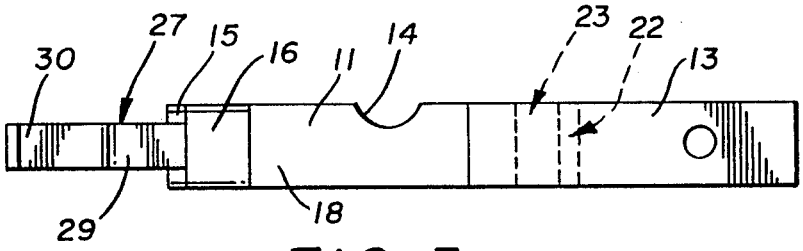
FIG. 3 is an end view of lines 3—3 of FIG. 1.
Figure 5:
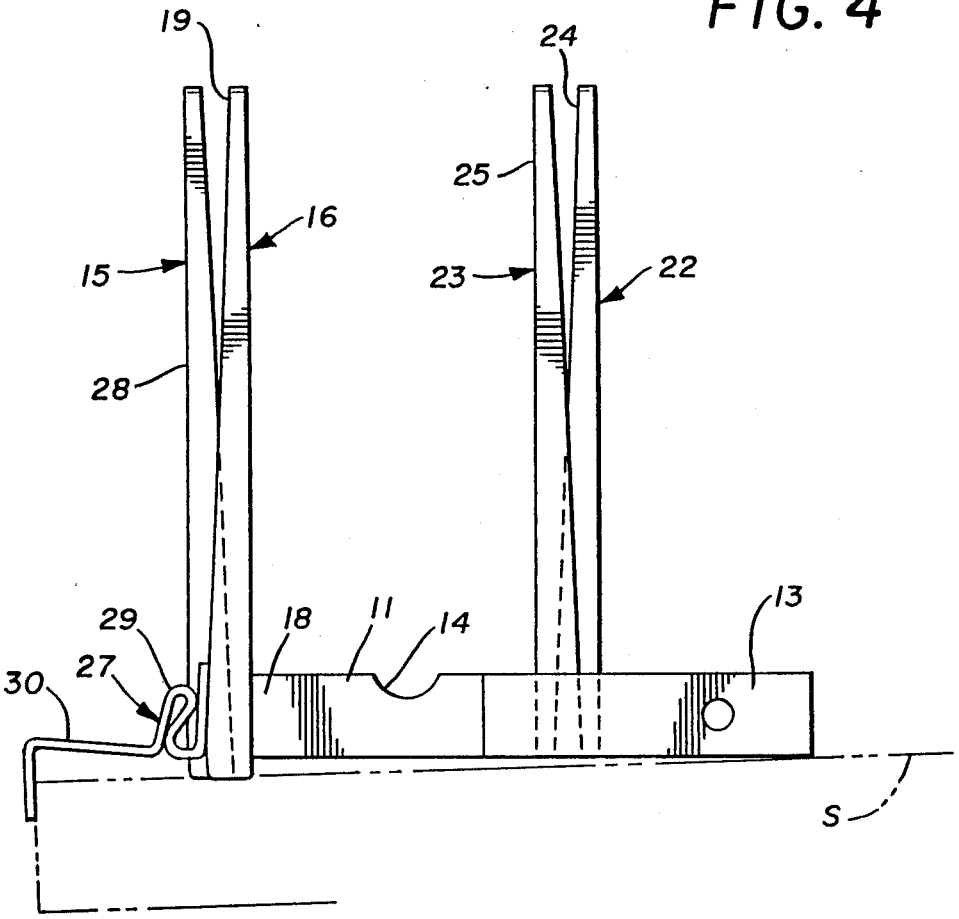
FIG. 5 is an end view on lines 5—5 of FIG. 2.

A foldable book holder 10 can be seen in FIGS. 1, 2, and 5 of the drawings comprising a support base 11 having a generally rectangular configuration with oppositely disposed horizontally extending leg portions 12 and 13. Each of the leg portions is tapered along its respective outer edge and extends on the same horizontal plane as that of the base 11 in general. A storage groove 14 is formed in the base 11 and extends longitudinally the entire length in spaced relation to said leg portions 12 and 13. A storage bore 14A is formed in angularly aligned relation in each of the leg portions 12 and 13 inwardly from their respective free ends and parallel to said storage groove 14. A pair of book engagement arms 15 and 16 are pivotally secured to the base 11 at its respective front corners 17 and 18 opposite said leg portions 12 and 13. Each of the arms is tapered along its length with arm 16 having a tapered front surface at 19 decreasing in depth as it extends upwardly to its free end 20. Conversely the arm 15 is tapered on its rear surface 21 in the same but reverse manner as that of arm 16. Referring now to FIG. 1 of the drawings, it can be seen that the arm 15 is spaced at its pivot point to said base 11 by a spacer element 15A while the arm 16 is pivoted directly to the front corner 18 of the base 11. It is thus evident that due to the arms respective tapered surfaces 21 and 19 that they will fold downwardly into horizontal and storage transport position in a uniform and matching configuration with the respective tapered surfaces 19 and 21 in abutting relation.

Figure 4:
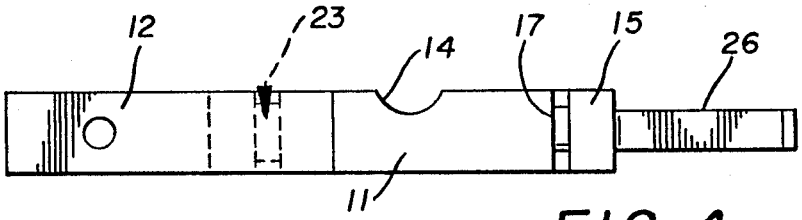
FIG. 4 is an end view on lines 4—4 of FIG. 1.

Referring back to FIGS. 1, 2, and 5 of the drawings, a secondary pair of arms 22 and 23 can be seen pivotally secured to the base 11 between said leg portions 12 and 13. The secondary arms 22 and 23 are also tapered along their respective opposite surfaces 24 and 25 and arm 22 is spaced at its pivot point to said base 11 by a secondary spacer 22A. Each of the respective arms 15, 16, 22 and 23 are transversely rounded at their pivoted ends and accordingly arms 22 and 23 clear the adjacent leg portions 12 and 13 as they are pivoted into folded flat position as illustrated in FIGS. 1 and 4 of the drawings. Since the arms 22 and 23 are tapered as the arms 15 and 16 are, they will fold in a uniform and matching configuration as said first arms hereinbefore described. The folded flat respective arms can be characterized as maintaining a parallel outer surfaces 24 and 25 respectively to said adjacent base 11. Referring now to FIGS. 2 and 5 of the drawings, it will be seen that book support clips 26 and 27 are positioned respectively on the pivoted ends of the arms 15 and 16 are secured to the front surfaces 19 and 28 respectively. The book support clip 27 has an upturned reversed portion 29 that abuts itself at the attachment point to the arm 16. The remaining clip portion 30 is angularly disposed from the horizontal plane of the base 11 as seen in FIG. 5 to support and hold a book representation B in broken lines. The clip 26 extends outwardly from said arm 15 at an inclined angle to match the clip 27 as hereinbefore described.

It will thus be apparent that pivoted ends of the arms 15 and 16, in the up position, extend below the horizontal plane of the bottom of the base 11 so that the foldable book holder is tilted at an angle in relation to a flat surface S on which it is positioned. The combination of the tilted base 11 and the angularly disposed relationship of the clips 26 and 27 provide a book rest that positions the book B and allows the respective pages of the book to be turned and held by the clip 27 as will be well understood by those skilled in the art.

Thus it will be seen that a new and novel foldable book rest has been illustrated and described and that various changes and modifications may be made therein without departing from the spirit of the invention.

Therefore I claim:

1. A foldable book holder to support and hold books in open displayed manner comprises a support base, oppositely disposed leg portions extending from said base, first and second pairs of spaced pivotally attached arms extending from said base, each arm of said pairs has a tapered surface said tapered surfaces of each pair of said arms abutting when said arms are in folded flat position against said base, means for spacing one of said arms in each of said pair in relation to said base at a point of pivotal attachment thereto, a book clip secured to each of said arms in said first pair at said point of pivotal attachment to said base.

2. The foldable book holder of claim 1 wherein said first pair of arms is of a known length and said second pair of arms is of length less than that of said first pair of arms.

3. The foldable book holder of claim 1 wherein said means for spacing one of said arms in each pair of arms in relation to said base comprises a spacer element at said point of pivotal attachment to said base.

4. A foldable book holder of claim 1 wherein one of said book clips is upturned and reversed upon an adjacent portion of said book clip to form an upturned reversed portion and wherein both of said clips extend angularly from said base.

5. A foldable book holder of claim 1 wherein said first pair of said arms extends below said base.

6. A foldable book holder of claim 1 wherein an elongated storage groove is formed in said base and a storage bore is formed in said leg portions of said base in spaced parallel relation to said groove.

7. The foldable book holder of claim 1 wherein said second pair of said spaced pivotally attached arms is secured to said base between said leg portions.

* * * * *